United States Patent [19]

Tominari

[11] Patent Number: 4,516,184

[45] Date of Patent: May 7, 1985

[54] CIRCUIT DEVICE FOR DRIVING ELECTROMAGNETICALLY MOVABLE UNIT AT HIGH SPEED WITH SINGLE POWER SOURCE

[75] Inventor: Noboru Tominari, No. 19-9, Kamiyama-cho, Shibuya-Ku, Tokyo, Japan

[73] Assignees: Noboru Tominari; Mikuni Kohyo Co., Inc., both of Japan

[21] Appl. No.: 335,578

[22] Filed: Dec. 29, 1981

[51] Int. Cl.[3] ..... H01H 47/32

[52] U.S. Cl. ..... 361/152; 361/156; 361/208

[58] Field of Search ..... 361/154, 156, 208, 152, 361/153, 159, 160, 155; 123/472, 487, 490, 499; 307/127, 138

[56] References Cited

U.S. PATENT DOCUMENTS

| | | | |
|---|---|---|---|
| 3,388,300 | 6/1968 | Allmark et al. | 361/152 |
| 3,662,987 | 5/1972 | Schlagmuller et al. | 251/139 |
| 4,313,571 | 2/1982 | Bellicardi et al. | 251/139 X |
| 4,385,339 | 5/1983 | Takada et al. | 361/154 |

FOREIGN PATENT DOCUMENTS

| | | | |
|---|---|---|---|
| 1179988 | 10/1964 | Fed. Rep. of Germany | 361/153 |
| 2015589 | 10/1970 | Fed. Rep. of Germany | 123/490 |
| 87405 | 7/1980 | Japan | 361/154 |
| 126906 | 10/1981 | Japan | 361/154 |

*Primary Examiner*—Harry E. Moose, Jr.

*Attorney, Agent, or Firm*—Stevens, Davis, Miller & Mosher

[57] ABSTRACT

A circuit device for driving an electromagnetically movable unit at a high speed with a single power source such as a battery comprises a plurality of power transistors for inverting the polarities of the input power, a pair of control transistors connected via a NOT element to the control circuit of the transistors for turning then alternately on or off, and instantaneous double voltage generator connected to the output circuit of the power transistors. Rapid responsiveness of the circuit device can be obtained by magnetically driving the movable unit in both one way and return way without a conventional return spring.

2 Claims, 3 Drawing Figures

CIRCUIT DEVICE FOR DRIVING ELECTROMAGNETICALLY MOVABLE UNIT AT HIGH SPEED WITH SINGLE POWER SOURCE

BACKGROUND OF THE INVENTION

This invention relates to a circuit device for driving an electromagnetically movable unit at a high speed with a single power source and, more particularly to a technique for electromagnetically driving a movable unit such as a fuel injection valve of an automotive engine with a single power source such as a DC 12 V battery at a high speed.

Most of the fuel injection valves high speed hydraulic valves for a conventional automotive engine have an electromagnetic coil and a resistor connected in series with the coil and are operated by switching a current flowing through the coil on or off in accordance with an input signal to thus switch the injection of fuel or the hydraulic pressure on or off with a single power source such as, for example, a DC 12 V battery.

Since the movement of the electromagnetically movable unit of the conventional circuit for driving the movable unit is conducted by a spring or a fuel pressure in one way, the force caused by the spring or the fuel pressure obstructs the electromagnetic force of the movable unit. Inasmuch as a resistor is further inserted in series with the electromagnetic coil of the conventional circuit, the movable unit does not sufficiently move with a high speed responsiveness with the input signal. In addition, if the resistance of the resistor is increased, the responsiveness of the movable unit decreases, and the resistance of the resistor cannot be considerably increased. Accordingly, the magnitude of the average current flowing in the electromagnetic coil of the movable unit becomes high, and the heat from the coil and the resistor becomes large and the coil uneconomically consumes a large amount of electric power.

Further, since the movable unit of the conventional circuit for driving the unit is driven by the electromagnetic force only in one way and driven by a mechanical force such as a spring or a fuel pressure in the return way, the movable unit such as a fuel injection valve is so constructed that the electromagnetic movable unit, and accordingly the permanent magnet unit, is of a solenoid valve type made of ferromagnetic material only. Consequently, the movable unit is attracted to a coil iron core unit to open the valve only if a current flows through the electromagnetic coil, even if the pole of the end of the movable unit of the coil iron core is either north N or S. However, when the valve seat is closed, the movable unit should interrupt the coil current and further return the movable unit by the force of the auxiliary spring and the fuel pressure. Thus, in order to accelerate the responsiveness of the valve with the movable unit in the conventional circuit, it must shorten the time required to return the movable unit with the result that the tension of the auxiliary spring should be strengthened. However, since the direction of the tension of the auxiliary spring acts reversely to that of the electromagnetic force for attracting the movable unit in the conventional circuit, the strengthened spring weakens the force for attracting the movable unit, causing the responsiveness for opening the valve seat to be decreased. As a consequence, it requires a large current and electric energy to produce a strong electromagnetic force considering the force of the auxiliary spring so as to obtain a quick responsiveness required of the movable unit.

SUMMARY OF THE INVENTION

A primary object of this invention is to provide a circuit device for driving an electromagnetically movable unit at a high speed with a single power source which eliminates the drawbacks and disadvantages of a conventional drive circuit for the movable unit by electromagnetically driving the movable unit in both a first way and a second return way without the force of the spring.

Another object of this invention is to provide a circuit device for driving an electromagnetically movable unit at a high speed with a single power source which can obtain a rapid responsiveness without increasing an electric current flowing through an electromagnetic coil by eliminating the use of the spring.

Still another object of this invention is to provide a circuit device for driving an electromagnetically movable unit at a high speed with a single power source which consumes less electric energy for constantly maintaining the open state of a valve seat than a conventional movable unit.

Still another object of this invention is to provide a circuit device for driving an electromagnetically movable unit at a high speed with a single power source which produces a low movable unit holding current and hence a low holding magnetic force, resulting in an accelerated responsiveness in the movable unit by remarkably increasing the voltage applied to the electromagnetic coil at the time of moving the movable unit in both the first way and the second return way while decreasing the voltage applied thereto at the time of retaining the unit.

Still another object of this invention is to provide a circuit device for driving an electromagnetically movable unit at a high speed with a single power source which generates low heat at the electromagnetic coil and consumes low electric power by decreasing the average current flowing through the electromagnetic coil.

Still another more specific object of the invention is to provide a circuit device for driving an electromagnetically movable unit at a high speed with a single power source which can employ a resistor of high resistance connected in series with the electromagnetic coil and accordingly economically decrease the ordinary voltage applied thereto.

According to one aspect of the present invention, there is provide a circuit device for driving an electromagnetically movable unit at a high speed with a single power source such as a battery or the like which comprises: a plurality of semiconductors or transistors for inverting the polarities connected to positive and negative terminals connected to the power source, a pair of semiconductors or transistors connected via a NOT element to the control circuit of said semiconductors or transistors and responsive to the input signal from said semiconductors or transistors for turning alternately on or off, and circuit means connected to the outputs of the positive and negative terminals connected to the power source in series for inverting the polarities of the voltage between the output terminals and doubling the voltage therebetween at the moment when the polarity of the signal is inverted. Thus, the movable unit can be electromagnetically forcibly driven in both a first way and a second return way without the force of a spring.

Accordingly, the circuit device of the present invention can remarkably improve the responsiveness of the movable unit and yet reduce the heat generated and the electric power consumed.

BRIEF DESCRIPTION OF THE DRAWINGS

These and other objects, features and advantages of the invention will be seen by reference to the description, taken in connection with the accompanying drawings in which.

DESCRIPTION OF THE PREFERRED EMBODIMENTS

Figure 1:
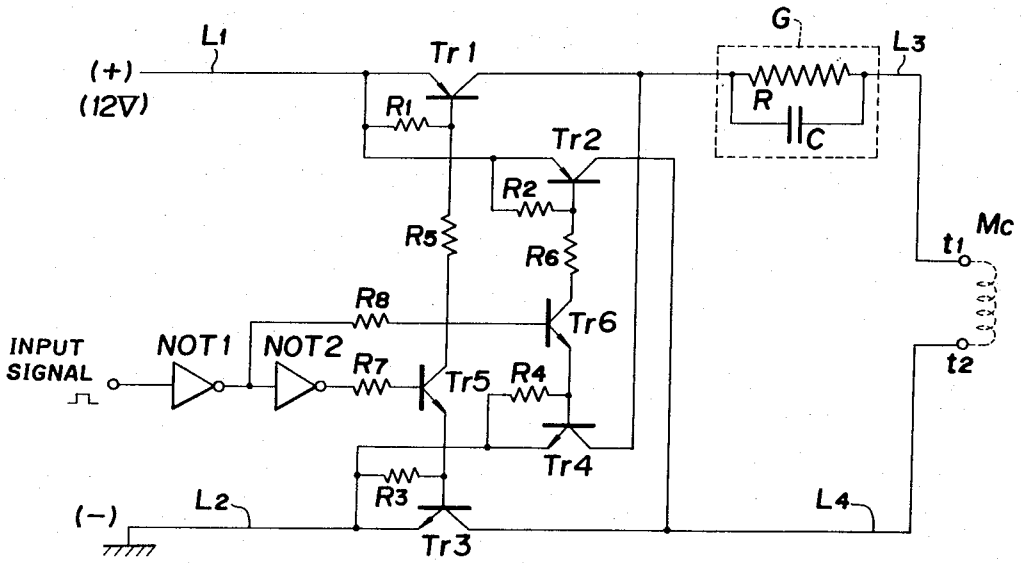
FIG. 1 is a circuit diagram of the preferred embodiment of the circuit device for driving an electromagnetically movable unit at a high speed with a single power source constructed according to this invention.
Figure 2:
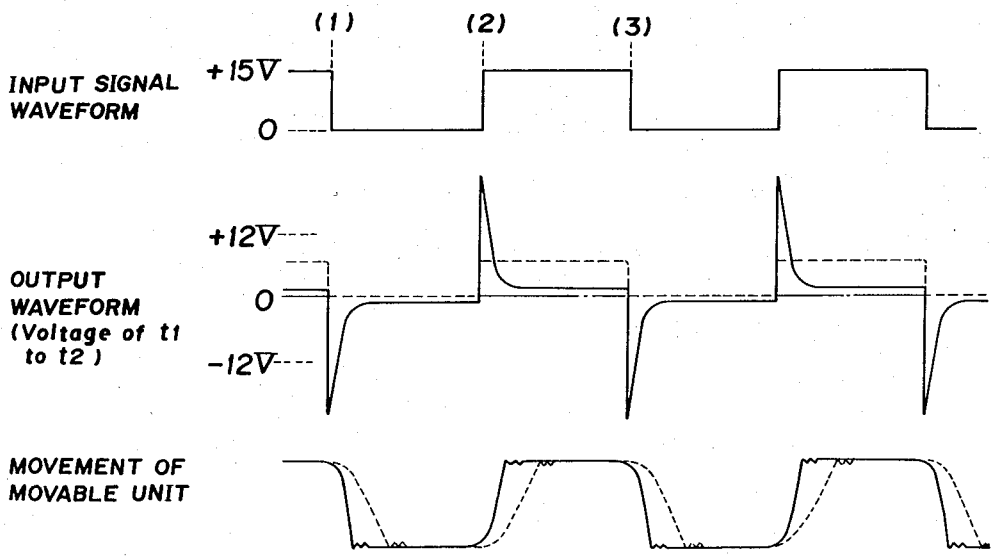
FIG. 2 is a graphical representation of the characteristics of the circuit device for driving the movable unit of this invention.

Reference is now made to the drawings and particularly to FIGS. 1 and 2 which show one preferred embodiment of the circuit device for driving an electromagnetically movable unit at a high speed with a single power source of the invention, wherein FIG. 1 shows the circuit device of this invention, and FIG. 2 shows the waveforms at various points in the circuit shown in FIG. 1 which help explain the purpose, operation and characteristics of the circuit device of the invention.

The construction and the operation of the component elements in the circuit device of the invention for one embodiment of the invention will now be described in detail.

As shown in FIG. 1, a set of two power transistors Tr1, Tr2 and Tr3, Tr4 are symmetrically connected to the positive (+) side line $L_1$ and the negative (−) side line $L_2$, respectively connected to a power source (12 volts) such as a 12 V battery or the like for inverting the polarity of the voltage between the output side lines $L_3$, $L_4$. A pair of control transistors Tr5, Tr6 are connected through NOT elements $NOT_1$, $NOT_2$ to the control circuit of the power transistors Tr1 through Tr4 to receive an input therefrom for alternately operating on or off in accordance with the on or off (+5 volts, 0 volt) of the input signal. Further, an instantaneous voltage doubling generator G is connected to either output side of the lines, $L_3$ and $L_4$ in series and has a resistor R of a resistance value approximately higher than the resistance value of a resistor used when a capacitor C is not connected and being of a value capable of holding the electromagnetically movable unit at a predetermined position, and a capacitor C connected in parallel with the resistor R. Resistors $R_1$ through $R_8$ are bias resistors, $t_1$, $t_2$ are output terminals which are, for example, connected to the electromagnetic coil of a fuel injection valve which will be described in greater detail.

In the circuit thus connected according to this invention when an input signal becomes zero as designated by the waveform (1) in FIG. 2(A), it is inverted via the NOT element $NOT_1$ as a low level, which is connected to the input of the control transistor Tr6, resulting in the conduction of the control transistor Tr6. Accordingly, the power transistors Tr2, Tr4 connected to the control transistor Tr6 are in turn conducted on concurrently. As a result, the power transistors Tr2 and Tr4 produce at their outputs a positive (+) voltage at the terminal $t_2$ and a negative (−) voltage at the terminal $t_1$, resulting in the production of an approximately double voltage (24 volts) between the terminals $t_1$ and $t_2$ instantaneously. The double voltage thus produced will drop in accordance with the time constant determined by the resistor R, the capacitor C and the external electromagnetic coil connected between the terminals $t_1$ and $t_2$ as designated by Mc. The output voltage thus produced between the output lines $L_3$ and $L_4$ will drop to a low voltage via the resistor R such as, for example, 2 to 3 volts, which is applied to the electromagnetically movable unit, and the residual voltage such as, for example 9 to 10 volts is stored in the capacitor C.

An input voltage signal of the waveform designated by (2) in FIG. 2(A) is then inputted similarly via the NOT element $NOT_1$ to the control transistor Tr6 in this state, and the control transistor Tr6 is subsequently turned off. On the other hand, the inverted output from the NOT element $NOT_1$ is further inverted via the NOT element $NOT_2$ to again attain a high level, which is in turn applied to the input of the control transistor Tr5, resulting in the conduction of the control transistor Tr5 on. Accordingly, the power transistors Tr1 and Tr3 connected to the control transistors Tr5 are in turn conducted on concurrently. On the other hand, an inverted output from the NOT element $NOT_1$ is applied to the input of the control transistor Tr6 as described above, resulting in the turning of the control transistor Tr6 off. Accordingly, the power transistors Tr2 and Tr4 connected to the control transistor Tr6 are in turn turned off concurrently. Consequently, the polarity of the voltage at the output lines $L_3$, $L_4$ is inverted, and hence the power transistors Tr1 and Tr3 produce at their outputs a negative (−) voltage at the terminal $t_2$ and a positive (+) voltage at the terminal $t_1$, and further the voltage of the capacitor C is superposed concurrently thereon, producing at the terminals $t_1$ and $t_2$ instantaneously a voltage output in the vicinity of double voltage such as 24 volts as indicated in FIG. 2(B). Thereafter, since the capacitor C will again charge the voltage at the polarity, the double voltage thus produced will drop to the low voltage component.

Subsequently, when the input signal applied to the NOT element $NOT_1$ is lowered to a low level as designated by (3) in FIG. 2(A), the inverted high level voltage from the NOT element $NOT_1$ is in turn applied to the input of the control transistor Tr6, resulting in the conduction of the control transistor Tr6. In this manner, since the polarity at the voltage output at the output lines $L_3$, $L_4$ is thus inverted similarly as described above, the power transistors Tr2 and Tr4 will produce via the double voltage generator G a negative double voltage such as −24 volts or the like in the similar manner to the above instantaneously as designated in FIG. 2(B).

Figure 3:
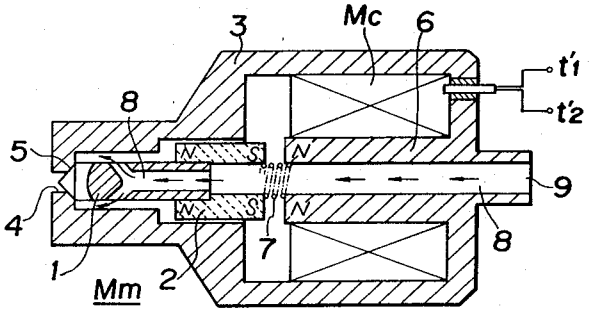
FIG. 3 is a longitudinally sectional elevational view of the fuel injection valve employed and exemplified in the circuit device for driving the movable unit of this invention.

FIG. 3 shows one preferred example of a fuel injection valve driven at high speed by the circuit device of the present invention, in which a permanent magnet is integrally mounted at the rear end of the electromagnetically movable valve opening on or closing off the fuel injection by the telescopic operation of the fuel injection valve body, a driving electromagnetic coil is arranged corresponding to the permanent magnet, and the electromagnetically movable valve is opened on or closed off in accordance with the attracting or repelling action of the permanent magnet for the magnetic pole of the electromagnetic coil to be inverted upon a change of the polarity of the voltage between the terminals applied to the electromagnetic coil.

As indicated in detail in FIG. 3, in the fuel injection valve an electromagnetically movable unit Mm having an electromagnetically movable valve 1 and a cylindfical permanent magnet 2 integrated with the valve 1 is so inserted into an injection valve housing 3 as to be telescopically movable therebetween. The end face of the permanent magnet 2 at the rear of the movable valve is confronted at an adequate interval with an iron core 6 of the electromagnetic coil Mc in such a manner that the fuel injection is interrupted when a valve seat unit 5 formed on the peripheral edge of a fuel injection port 4 makes contact with the end of the movable valve 1 and it is conducted when the seat unit 5 is opened. It is noted that a weak auxiliary spring 7 may be interposed as required at the interval therebetween. A fuel flow passage 8 is formed at the center of the iron core unit 6 of the electromagnetically movable unit Mm and the electromagnetic coil Mc. The electromagnetic coil Mc is mounted on the outer periphery of the iron core 6, and the electric current to the coil Mc is applied via the terminals of the coil led out of the housing and hence terminals $t'_1$, $t'_2$ connected to the output terminals $t_1$, $t_2$ of the circuit shown in FIG. 1.

The magnetizing direction of the permanent magnet 2 is so determined as shown in FIG. 3 that the telescoping direction of the electromagnetically movable valve 1 and hence both the ends of the cylindrical magnet may become north N and south S poles so that the south pole is disposed at the side of the iron core unit 6. Reference numeral 9 represents a fuel flow inlet.

The operation of the fuel injection valve thus constructed according to this invention will now be described.

When an electric current flows via the terminals $t'_1$, $t'_2$ to the electromagnetic coil Mc of the fuel injection valve and a north N pole is produced at the end of the movable unit Mm of the coil iron core unit 6, the north pole attracts the south pole of the permanent magnet 2 of the movable unit Mm, and the movable unit Mm is thus attracted thereto. Thus, the valve seat 5 is opened, and accordingly pressurized fuel is injected from the injection port 4. When reverse current to the above flows through the electromagnetic coil Mc, the south pole is produced at the end of the movable unit Mm of the coil iron core unit 6, and the south pole of the movable unit Mm thus repels the south pole of the permanent magnet 2, and consequently the movable unit Mm is returned forcibly by the magnetic force to close the valve seat 5, and thus the fuel injection is interrupted.

In addition, since the fuel injection valve of this invention thus constructed is so operated that the movable unit is fully electromagnetically moved back and forth as was described, the construction and the operation of the fuel injection valve thus constructed are improved as described above, and the electromagnetically movable unit Mm does not need the repelling force of an auxiliary spring Accordingly, it can obtain rapid responsiveness without increasing the current value. Further, the electric energy flowing ordinarily to maintain, the valve seat 5 in an open state may be smaller than if a spring is used. Even if an auxiliary spring is temporarily employed in the valve, it may have a weak tension of sufficient degree for maintaining the valve seat 5 in a closed state at the time no current flows and hence at the time the valve does not operate, but the spring may not be used for accelerating the responsiveness of the valve, and consequently it is not necessary if the seating property of the valve seat 5 is proper.

Referring back to FIG. 2(B), the waveform of the drive circuit for the movable unit designates the operation of the circuit device of this invention with solid lines and that of the conventional circuit device with broken lines.

As evident from the waveforms in FIG. 2, the conventional drive circuit magnetically drives the movable unit only in one way as designated by broken lines, but the drive circuit of this invention magnetically drives the movable unit in both a first way and a second return way as designated by sold lines. The operating voltage is remarkably high as compared with the conventional circuit at the operating time, and the ordinary voltage is small as compared with the conventional one. Consequently, the movable unit holding current and hence the holding magnetic force is reduced, resulting in rapid demagnetizing of the electromagnetic coil, which contributes to the acceleration of the responsiveness. Further, the average current of an electromagnetic coil becomes lower than the conventional circuit, which resultantly decreases the quantity of heat generated from the electromagnetic coil and electric power consumption.

FIG. 2(C) shows the comparison waveforms of the movement of the electromagnetically movable unit between the circuit device of this invention and the conventional circuit. The circuit device of this invention, as designated by solid lines, can obtain excellent responsiveness as compared with the conventional circuit device as designated by broken lines.

It should be appreciated from the foregoing description that since the circuit device of this invention employs transistors for inverting the polarity of the power source in accordance with the on or off signal, and an instantaneous double voltage generator connected in the output circuit of the transistor circuit for inverting and doubling the voltage in polarity between the output terminals instantaneously to thus produce the double voltage output instantaneously at the moment for moving the movable unit, it can remarkably accelerate the responsiveness of the movement of the movable unit as compared with the conventional circuit, and since the resistor R connected in series with the electromagnetic coil in the drive circuit can be increased as compared with that in the conventional circuit, the ordinary voltage can be reduced in the circuit device and the average current of the electromagnetic coil can be also reduced as compared with the conventional one, making it economic.

What is claimed is:

1. A circuit device for driving an electromagnetically movable unit at a high speed with a single power source comprising:

positive and negative input lines, first and third transistors, one being connected at an emitter thereof to said positive input line and another being connected at an emitter thereof to said negative input line, second and fourth transistors, one being connected at an emitter thereof to said positive input line and another being connected at an emitter thereof to said negative input line, a control signal input line, a fifth transistor connected at the collector thereof to the base of said first transistor and at the emitter therof to the base of said third transistor, a sixth transistor connected at the collector thereof to the base of said second transistor and at the emitter thereof to the base of said fourth transistor, a first NOT element connected at the input thereof to said control signal input line and at the output thereof to the base of said sixth transistor for inverting the input control signal applied thereto, a second NOT element connected at the input thereof to the output of said first NOT element and at the output thereof to the base of said fifth transistor for inverting the output from said first NOT element, a first output line connected at one end to the collector of said first transistor and the collector of said fourth transistor, a second output line connected at one end to the collector of said third transistor and the collector of said second transistor, a first output terminal connected to the other end of said first output line, a second output terminal connected to the other end of said second output line, and an instantaneous double voltage generating means connected in series with said output line circuit and having a resistor and a capacitor connected in parallel with the resistor for inverting and doubling the voltage between the output lines when said input signal is inverted in polarity.

2. A circuit device for driving an electromagnetically movable unit at a high speed with a single power source comprising:

positive and negative input lines;

first and third transistors, one being connected at an emitter thereof to said positive input line and another being connected at an emitter thereof to said negative input line;

second and fourth transistors, one being connected at an emitter thereof to said positive input line and another being connected at an emitter thereof to said negative input line;

a control signal input line;

a fifth transistor connected at the collector thereof to the base of said first transistor and at the emitter thereof to the base of said third transistor;

a sixth transistor connected at the collector thereof to the base of said second transistor and at the emitter thereof to the base of said fourth transistor;

a first NOT element connected at the input thereof to said control signal input line and at the output thereof to the base of said sixth transistor for inverting the input control signal applied thereto;

a second NOT element connected at the input thereof to the output of said first NOT element and at the output thereof to the base of said fifth transistor for inverting the output from said first NOT element;

a first output line connected at one end to the collector of said first transistor and the collector of said fourth transistor; and a second output line connected at one end to the collector of said third transistor and the collector of said second transistor.

* * * * *

UNITED STATES PATENT AND TRADEMARK OFFICE

CERTIFICATE OF CORRECTION

PATENT NO. : 4,516,184

DATED : May 7, 1985

INVENTOR(S) : Noboru Tominari

It is certified that error appears in the above-identified patent and that said Letters Patent is hereby corrected as shown below:

[73] Assignees: Noboru Tominari; Mikuni Kogyo Co., Inc. both of Japan.

This Certificate supersedes Certificate of Correction issued December 3, 1985.

Signed and Sealed this

*Twentieth* Day of *May 1986*

[SEAL]

*Attest:*

DONALD J. QUIGG

*Attesting Officer*

*Commissioner of Patents and Trademarks*